US010696000B2

(12) United States Patent
Kosse

(10) Patent No.: US 10,696,000 B2
(45) Date of Patent: Jun. 30, 2020

(54) PRESS DRIVE DEVICE FOR A PRESS, AND PRESS COMPRISING A PRESS DRIVE DEVICE

(71) Applicant: Schuler Pressen GmbH, Göppingen (DE)

(72) Inventor: Marcus Kosse, Heiningen (DE)

(73) Assignee: Schuler Pressen GmbH, Göppingen (DE)

( * ) Notice: Subject to any disclaimer, the term of this patent is extended or adjusted under 35 U.S.C. 154(b) by 428 days.

(21) Appl. No.: 15/520,705

(22) PCT Filed: Oct. 8, 2015

(86) PCT No.: PCT/EP2015/073238

§ 371 (c)(1),
(2) Date: Apr. 20, 2017

(87) PCT Pub. No.: WO2016/062546

PCT Pub. Date: Apr. 28, 2016

(65) Prior Publication Data

US 2017/0313011 A1 Nov. 2, 2017

(30) Foreign Application Priority Data

Oct. 20, 2014 (DE) ..... 10 2014 115 241

(51) Int. Cl.
*B30B 1/14* (2006.01)
*B30B 1/26* (2006.01)

(52) U.S. Cl.
CPC ..... *B30B 1/14* (2013.01); *B30B 1/26* (2013.01); *B30B 1/266* (2013.01)

(58) Field of Classification Search
CPC .. B30B 1/14; B30B 1/26; B30B 1/266; B30B 1/02; B30B 1/06; B30B 1/10
(Continued)

(56) References Cited

U.S. PATENT DOCUMENTS 3,983,738 A * 10/1976 Vlasov ..... B21J 9/18 72/429
4,560,895 A 12/1985 Zahner
(Continued)

FOREIGN PATENT DOCUMENTS

CN 203460455 U 3/2014
CN 104001846 A 8/2014
(Continued)

OTHER PUBLICATIONS

Machine translation of JP-61276797-A, pp. 1-4 of specifcation and 1-2 of Espacenet summary, accessed on Apr. 4, 2019. (Year: 2019).*
(Continued)

*Primary Examiner* — Teresa M Ekiert
*Assistant Examiner* — Sarkis A Aktavoukian
(74) *Attorney, Agent, or Firm* — Fitch, Even, Tabin, & Flannery LLP

(57) ABSTRACT

A press drive device (21) includes a connecting rod (49) with input (48) and output ends (50). A drive shaft (35) is mounted to be rotatable about a shaft axis W and includes a connecting rod bearing (46) that is eccentric in relation to the shaft axis W. A drive unit (77) includes a driving motor (30) and a planetary gear set (76) to drive the drive shaft (35). A gear output (79) connects to the drive shaft (35), and a gear input (78) connects to a motor shaft (73). The driving motor (30) includes a rotor (66) connected in a rotationally fixed manner to the motor shaft (73) via a rotor hub (67). The rotor (66) is concentric to the motor shaft creating mounting space between the motor shaft (73) and the rotor (66) and designed to arrange a braking device (31) therein.

17 Claims, 10 Drawing Sheets

(58) Field of Classification Search
USPC ..... 100/280, 282, 283, 286
See application file for complete search history.

(56) References Cited

U.S. PATENT DOCUMENTS

| | | | | |
|---|---|---|---|---|
| 8,505,449 | B2 * | 8/2013 | Lauke | B21J 9/18 100/282 |
| 2002/0077207 | A1 | 6/2002 | Fahbenbach | |
| 2009/0247345 | A1 * | 10/2009 | Desch | B30B 1/266 475/149 |
| 2011/0083568 | A1 * | 4/2011 | Fahrenbach | B30B 1/266 100/214 |
| 2011/0126649 | A1 | 6/2011 | Darr | |

FOREIGN PATENT DOCUMENTS

| | | | | |
|---|---|---|---|---|
| DE | 19827756 | A1 | 12/1999 | |
| DE | 102008034971 | A1 | 1/2010 | |
| DE | 102008063473 | A1 | 7/2010 | |
| DE | 102011113624 | A1 | 3/2013 | |
| EP | 0111350 | B1 | 10/1986 | |
| EP | 1126581 | A2 | 8/2001 | |
| EP | 1800850 | A2 | 6/2007 | |
| EP | 1923207 | A2 | 5/2008 | |
| EP | 2105290 | A1 | 9/2009 | |
| JP | 61276797 | A * | 12/1986 | B30B 1/266 |
| JP | S61276797 | A | 12/1986 | |
| WO | 0159914 | A1 | 8/2001 | |

OTHER PUBLICATIONS

International Search Report in corresponding International Application No. PCT/EP2015/073238, dated Jan. 1, 2016, 10 pages.
German Office Action in corresponding German Application No. 10 2014 115 241.7, dated Jul. 28, 2015, 15 pages.

* cited by examiner

PRESS DRIVE DEVICE FOR A PRESS, AND PRESS COMPRISING A PRESS DRIVE DEVICE

CROSS REFERENCE TO RELATED APPLICATIONS

This patent application is the national phase of PCT/EP2015/073238 filed Oct. 8, 2015, which claims the benefit of German Patent Application No. 10 2014 115 241.7 filed Oct. 20, 2014.

TECHNICAL FIELD

The invention relates to a press drive device for a press that is disposed for driving a ram of the press. Furthermore, the invention relates to a press that comprises such a press drive device.

BACKGROUND

Press drive devices for driving a press ram have been known in many different modifications. The use of electric motors or servomotors in the press drive device has already been suggested many times. For example, publication DE 10 2008 034 971 A1 describes a press comprising several direct-drive modules, each acting on a pressure point of the slide. A servomotor can be used in the direct-drive module. The servomotors of different direct-drive modules can either be mechanically coupled or electronically synchronized. In electronic synchronization with four pressure points, the ram can be rotated or tilted about two axes that are perpendicular to each other.

Publication DE 10 2008 063 473 A1 suggests a press drive that can be set up modularly. An electric driving motor, for example a servomotor or a torque motor, may be arranged in a transmission module at a press interface. Furthermore, a brake may be present in the motor module. The motor can be connected to the press via a transmission module comprising an appropriate interface.

Another modular drive system for a press has been known from publication DE 10 2011 113 624 A1. A crankshaft is supported via a radial bearing in a drive housing. The drive is flange-mounted on the side of the drive housing. A connecting rod is mounted to a connecting rod bearing of the crankshaft, said connecting rod converting the rotary motion of the crankshaft into an oscillating motion. A braking device and a planetary gear may be interposed between the drive and the drive housing. The brake and the drive may also be connected to the transmission on opposite sides. Due to the modular design, various installation options are provided.

SUMMARY

In conventional presses the required mounting space for the press drive device is frequently considerable. Therefore, the object of the present invention may be viewed as the provision of a press drive device or a press that allows a more compact design.

The press drive device comprises a connecting rod that has a driving end and a driven end. The driven end is preferably coupled with the ram via a toggle lever mechanism. Furthermore, the press drive device comprises a drive shaft, for example a crankshaft or an eccentric shaft. The drive shaft is supported so as to be rotatable about a shaft axis. Opposite the shaft axis, it comprises an eccentrically arranged connecting rod bearing. The driving end of the connecting rod is supported on the connecting rod bearing.

The press drive device comprises at least one electric driving motor, in particular a torque motor, with a stator and a rotor. A "torque motor" is understood to mean a servomotor that is designed for high torques at low rates of revolution. The torque motor has a high number of pole pairs. The diameter of a torque motor is preferably clearly greater than its axial dimension. The torque motor requires only a small mounting space in axial direction.

There is provided at least one drive housing. Preferably, at least one first and one second drive housing are provided. The number of drive housings may also be greater than two. The first drive housing and the second drive housing are arranged on axially opposite sides of the connecting rod bearing. The first drive housing and the second drive housing are arranged on the axially opposite sides of the connecting rod bearing. Preferably, the drive shaft extends into the first and/or the second drive housings.

In one or more of the provided drive housings, there is arranged one driving motor, respectively, comprising a stator and a hollow cylindrical rotor. The housing interior provides a mounting space for the driving motor. Preferably, the rotor is arranged radially inside the stator. The rotor may bear permanent magnets on its side facing the stator.

The rotor is supported by a rotor hub. The rotor is connected to the rotor hub in a rotationally fixed manner. The rotor, or at least parts thereof, and the rotor hub may also be designed as an integral part—without seams and joints. The rotor hub, in turn, is coupled to the drive shaft in a rotationally fixed manner. The rotation of the rotor by a specific angle of rotation about the shaft axis thus causes the rotation of the rotor hub and the drive shaft by the same angle of rotation.

The press drive device comprises at least one planetary gear set. Each existing driving motor may be associated with a planetary gear set. A driving motor and an associate planetary gear set form one common drive unit. Each drive unit may be arranged in a separate drive housing. It is also possible to arrange the planetary gear set and the driving motor of a common drive unit in two separate drive housings that are arranged axially next to each, other relative to the shaft axis, and that can be connected to each other.

The planetary gear set comprises a gear input and a gear output. The gear input is connected to the motor shaft in a rotationally fixed manner. The planetary gear set displays a gear ratio of at least 3, and of preferably 5, between the gear input and the gear output. Preferably, the gear ratio is a whole number or a decimal number with a finite number of decimal places, in particular fewer than 5 or fewer than 3 decimal places. Therefore, by determining the rotary position or the angle of rotation of the motor shaft by means of a press control, it is possible to determine, very simply and accurately, the rotary position and the angle of rotation of the drive shaft, without requiring a separate detection of their turned position.

Radially between the motor shaft and the rotor and radially adjacent to the rotor hub, the arrangement forms a mounting space that is disposed for installing a braking device in the respective drive housing.

As a result of the inventive design of the press drive device, it is possible to arrange a drive unit and/or a braking device in the manner of a module in a drive housing. Therefore, the press drive device can be flexibly adapted to the press. Furthermore, the mounting space is very small, in particular in axial direction parallel to the shaft axis. Consequently, it is possible to implement a compact press, wherein the shaft axis of the at least one drive shaft is oriented in the direction in which the workpiece transport also occurs. In doing so, the press drive device preferably does not extend beyond the outside contour of the press frame of the press. As a result, the accessibility to the front side and the rear side of the press is considerably improved, in view of the workpiece transport and/or the replacement of the press tool.

The planetary gear set comprises a sun wheel, a hollow wheel and several planetary wheels arranged between the sun wheel and the hollow wheel, and planetary wheels in engagement with the sun wheel as well as with the hollow wheel. Preferably, the planetary wheels are rotationally supported by a common planetary wheel carrier. In one exemplary embodiment, the drive input is formed by the sun wheel. In doing so, the sun wheel is preferably directly connected to the motor shaft in a rotationally fixed manner and can, for example, be directly seated on the motor shaft. It is also possible to configure the motor shaft and the sun wheel in an integral manner, without seams and joints.

The diameter of the motor shaft may be large along the shaft axis, relative to the shaft axial length, as a result of which there is high torsional stiffness. Consequently, the motor shaft does not act as a torsion spring. For example, the ratio of the diameter divided by the length of the motor shaft may be greater than 0.1 or 0.25 or than 0.3 or than 0.5 or than 0.7 or greater than or equal to 1.0. The detection of the rotary position of the drive shaft by means of a rotary position measurement of the motor shaft is thus highly precise.

Thus, in one exemplary embodiment, the gear output may be represented by the planetary wheel carrier. The planetary wheel carrier is supported so as to be rotatable about the shaft axis.

The planetary wheels may be overhung. Alternatively, it is also possible to support the planetary wheels on the drive housing and/or on the motor shaft.

In a preferred embodiment of the press drive device, the gear input is coupled with the drive shaft via a coupling arrangement in a rotationally fixed manner. In doing so, the coupling arrangement is configured, in particular, in such a manner that a radial movement radially with respect to the shaft axis is made possible between the drive shaft and the gear output. In the direction of rotation or in peripheral direction about the shaft axis, the coupling arrangement establishes—preferably with minimal play—a connection in a rotationally fixed manner between the gear output and the drive shaft. Furthermore, it is advantageous if the coupling arrangement allows an axial relative movement between the gear output and the drive shaft.

In the embodiment, the drive shaft is rotatably supported only via two bearing locations. The first bearing mechanism and/or the second bearing mechanism are preferably roller bearings; however, they may also be configured as sliding bearings in presses displaying greater press and connecting rod forces, respectively.

In a preferred exemplary embodiment, the drive shaft is rotatably supported, at a first bearing location, via a first bearing mechanism and, at a second bearing location, via a second bearing mechanism. The two bearing locations are arranged on axially opposite sides relative to the connecting rod bearing. The first bearing mechanism is located between a first bearing part and the drive shaft, and the second bearing mechanism is located between a second bearing part and the drive shaft.

Preferably, the first bearing mechanism is a fixed bearing and the second bearing mechanism is a movable bearing. Hence, axial expansions of the drive shaft do not lead to tensions in the press drive device. Any axial migration of the drive shaft is prevented by the fixed bearing.

Preferably, the first bearing mechanism is provided in the region of the coupling arrangement. The gear output and/or the coupling arrangement and/or the drive shaft are supported or borne by the first bearing mechanism. Preferably, the first bearing mechanism is located between the first bearing part and the gear output or the coupling arrangement, so that the drive shaft is indirectly supported via the first bearing mechanism on the drive housing.

It is preferred if a first drive housing and a second drive housing are provided. In particular, the two drive housings are arranged on different axial sides of the connecting rod bearing.

Each drive housing may also have a peripheral wall extending in peripheral direction about the shaft axis and/or coaxially with respect to the shaft axis. In particular, the stator of a driving motor may be arranged on the inside surface of the peripheral wall associated with the shaft axis. At least in the first and the second drive housings, there preferably exists at least one inside wall, respectively. The inside wall is connected to the peripheral wall on the axial side that faces the connecting rod bearing and that may be referred to as the axial side of the first and the second drive housings, respectively. Thus the drive housing has the shape of a pot. The inside wall has an opening in the region of the shaft axis.

It is advantageous if the first bearing part is integral with the first bearing location of the first drive housing and/or if the second bearing part is integral with the second bearing location of the second drive housing. In particular, the first bearing location is on the inside wall of the first drive housing, and the second bearing location is on the inside wall of the second drive housing. There, the drive shaft is indirectly or directly supported by the inside wall via the respective bearing mechanism. In the event of this arrangement, the drive shaft is thus not supported by the press frame but, preferably only by the two drive housings. However, it is also possible to additionally support the drive shaft on the press frame—in particular in the case of presses displaying greater press forces.

In one advantageous exemplary embodiment of the press drive device, the motor shaft is supported at a motor shaft bearing location—via a motor shaft bearing mechanism—on the drive housing, through which it extends, for example on the first drive housing. Preferably, the motor shaft bearing location is axially adjacent to the gear input and, in particular, arranged as closely as possible thereto. The motor shaft bearing mechanism may display—viewed in axial direction of the shaft axis—a greater axial dimension than the first and/or the second bearing mechanisms for bearing the drive shaft. In the exemplary embodiment, the motor shaft bearing location or the motor shaft bearing mechanism is arranged between the gear input and the driving motor or between the gear input and the rotor hub. In doing so, it is advantageous if the mounting space for the braking device is located between the motor shaft bearing mechanism and the rotor hub. To do so, for example, the rotor hub can be connected to the axial end of the rotor, said end facing away from the motor shaft bearing mechanism.

The motor shaft and/or the rotor hub and/or the rotor are preferably supported only via the motor shaft bearing mechanism at the motor shaft bearing location. Consequently, the rotor and/or the rotor hub are indirectly supported by the drive housing via the motor shaft. Viewed from the connecting location of the rotor hub with the motor shaft, the rotor and the rotor hub, respectively, are supported only on one axial side.

One exemplary embodiment comprises a braking device. In an emergency, for example an electric power failure, the braking device is disposed to stop the movement of the ram. One braking device each may be arranged in one or more of the existing drive housings.

Preferably, the rotor is mounted to one axial end of the rotor hub. For example, it is possible to arrange a driving motor, as well as a braking device in one drive housing. In doing so, the braking device may axially engage at least partially into the mounting space between the rotor and the shaft axis. In doing so, the braking device is arranged preferably axially adjacent to the rotor hub.

In one advantageous exemplary embodiment, the rotor hub has a hollow shaft that encloses the drive shaft. In the direction of rotation, i.e., the peripheral direction around the shaft axis, the hollow shaft may be connected to the motor shaft in a force-locking and/or form-locking manner. Spokes may extend from the hollow shaft, or a disk may extend essentially radially or obliquely with respect to the shaft axis, in which case the rotor is supported by the disk or the spokes.

It is advantageous if each of the first and the second drive housings comprises a mounting flange for mounting to a press frame. Preferably, the mounting flange is arranged at a location that is at an axial distance from the inner axial side associated with the connecting rod bearing or at an axial distance from the gear output. The mounting flange may be configured as an annular flange. The first and the second drive housings are preferably mounted to two opposing plates or cheeks for the press frame in such a manner that only the annular flange and the mounting screws project from the intermediate space defined by the two plates or cheeks of the press frame.

An optionally present third drive housing may be mounted, by means of a connecting flange, to the mounting flange of the first or second drive housing. In this manner, it is possible, in principle, to connect any number of drive housings axially adjacent to each other and to connect them to the first and/or second drive housings.

In one embodiment the press drive device does not extend beyond the outside contour of the press frame. The "outside contour" is understood to mean a smallest-possible parallel epiped that is located in the press frame. Due to this configuration, it is possible to achieve a compact design of the press drive device. In particular, it is possible to arrange the press drive device on or in the press frame, for example in the head part of a press. Furthermore, there results the advantage that a tool change is simplified because the region directly in front of or behind the press is easily accessible from the top; and a tool to be replaced, for example by means of a crane, can be deposited on the press table directly next to the press frame.

High torques can be implemented via the electric driving motor or torque motor. Due to the direct connection of the rotor to the drive shaft, high angular accelerations and decelerations of the drive shaft are possible. These are transmitted to the ram via the connecting rod and the preferably existing toggle lever mechanism. Consequently, accelerations and declarations of the ram are accomplished at high rates. The press drive device or a press equipped therewith thus displays high dynamics in addition to the high energy efficiency. In one exemplary embodiment, the full rate of revolutions of the press drive device is achieved in less than 40 milliseconds. This is due to the fact that the press drive device displays, in addition to minimal friction, only minimal mass moments of inertia—also in proportion to the available torque.

The rotor and/or the rotor hub and/or other components that are connected to the drive shaft in a rotationally fixed manner may act—by increasing their weight and/or by installing at least one gyrating mass element—as a gyrating mass. The free mounting space available in the housing interior may be used to provide such an additional gyrating mass. The additional mass must be arranged so as to be without unbalance.

Preferably, the shaft axis preferably extends in a depth direction, in which the transport of the workpiece to and from the press also takes place.

A press in accordance with the present invention may comprise one or more of the press drive devices described hereinabove. Each press drive device is allocated, in particular, one toggle lever mechanism that is acted upon by the connecting rod of the press drive device. If the press comprises several press drive devices, these are not mechanically coupled to each other. Each press drive device used in the press is able to adjust the angle of rotation of the drive shaft and thus the position of the connecting rod or the toggle lever mechanism—independently of the other press drive devices. The press drive devices are coordinated by a press control and coupled in a controlled manner, so to speak.

BRIEF DESCRIPTION OF THE DRAWINGS

Advantageous embodiments of the invention can be inferred from the dependent patent claims, as well as from the description. The invention will be explained in detail hereinafter with reference to the appended drawings. They show in FIG. 1 a perspective view of an exemplary embodiment of a press comprising two press drive devices;

DETAILED DESCRIPTION

Figure 7:
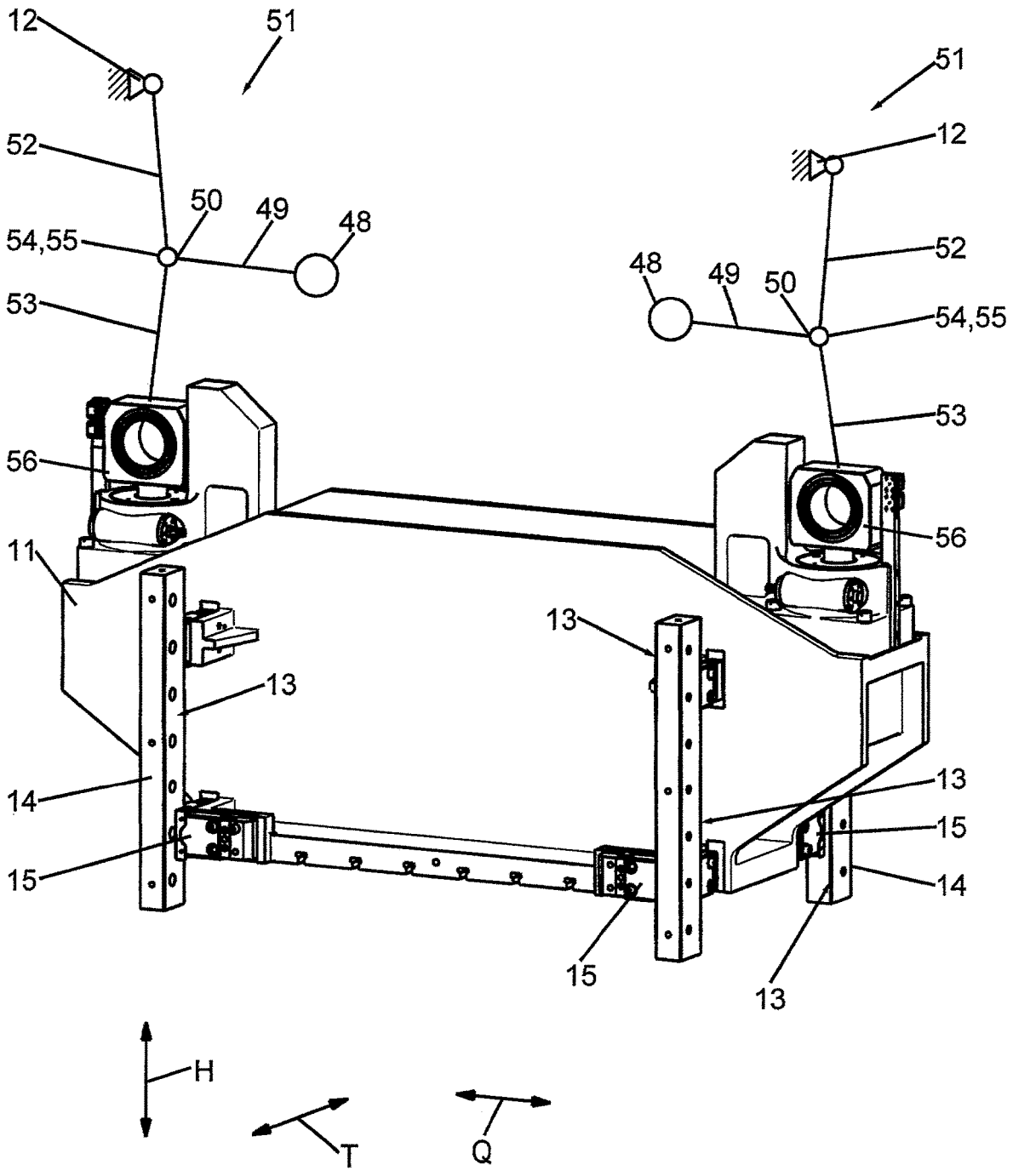
FIG. 7 a perspective view of a press ram and the ram guide of the press as in FIGS. 1 to 6, as well as a schematic representation of an exemplary embodiment of the toggle lever mechanism of the press.

FIGS. 1 to 4 show various views of an exemplary embodiment of a press 10. The press 10 comprises a ram 11 that is supported so as to be movably guided in one stroke direction H, in particular in vertical direction, on a press frame 12. For guiding the ram 11, there are provided on the ram 11, in accordance with the example, rolls 15 that are in abutment with a respectively provided abutment surface 13 of a guide element 14 on the press frame side (FIG. 7).

The press frame 12 comprises a foot part 18 with a press table 19. A lower tool may be arranged on the press table 19. The lower tool may interact with an upper tool that is located on the ram 11. In the press 10 described herein, the lower tool is arranged so as to be immovable relative to the press frame 12. It is only the upper tool that can be moved relative to the press frame and the lower tool by means of the ram 11. The press 10 can be used for cutting and/or punching, stamping and/or drawing and/or bending and/or for other forming processes.

Furthermore, the press frame 12 has a head part 20. The ram 11 is located between the head part 20 and the foot part 18. In the exemplary embodiment illustrated here, the press 10 is embodied as a monoblock press, wherein the foot part 18 and the head part 20 of the press frame 12 are connected via two connecting parts or lateral stands to each other in a transverse direction Q at a distance from each other, said connecting parts respectively extending from the foot part 18 to the head part 20 in stroke direction H. In modification thereof, the press 10 could also be configured as a C-frame press or as a divided design, wherein the press elements (head piece, stand, press table) are suitably connected to each other.

A depth direction T is oriented at a right angle with respect to stroke direction H and with respect to transverse direction Q. Viewed in depth direction T, the press 10 has a front side (FIG. 2) and a rear side opposite the front side. In the press 10 illustrated here, the transport of a workpiece takes place from the front side or the rear side into the press 10, and out of the press 10 to the front side or to the rear side, respectively.

On the head part 20, there is arranged at least one press drive device 21—two in the exemplary embodiment described here. The at least one press drive device 21 is disposed for moving the ram 11 in stroke direction H.

Figure 5:
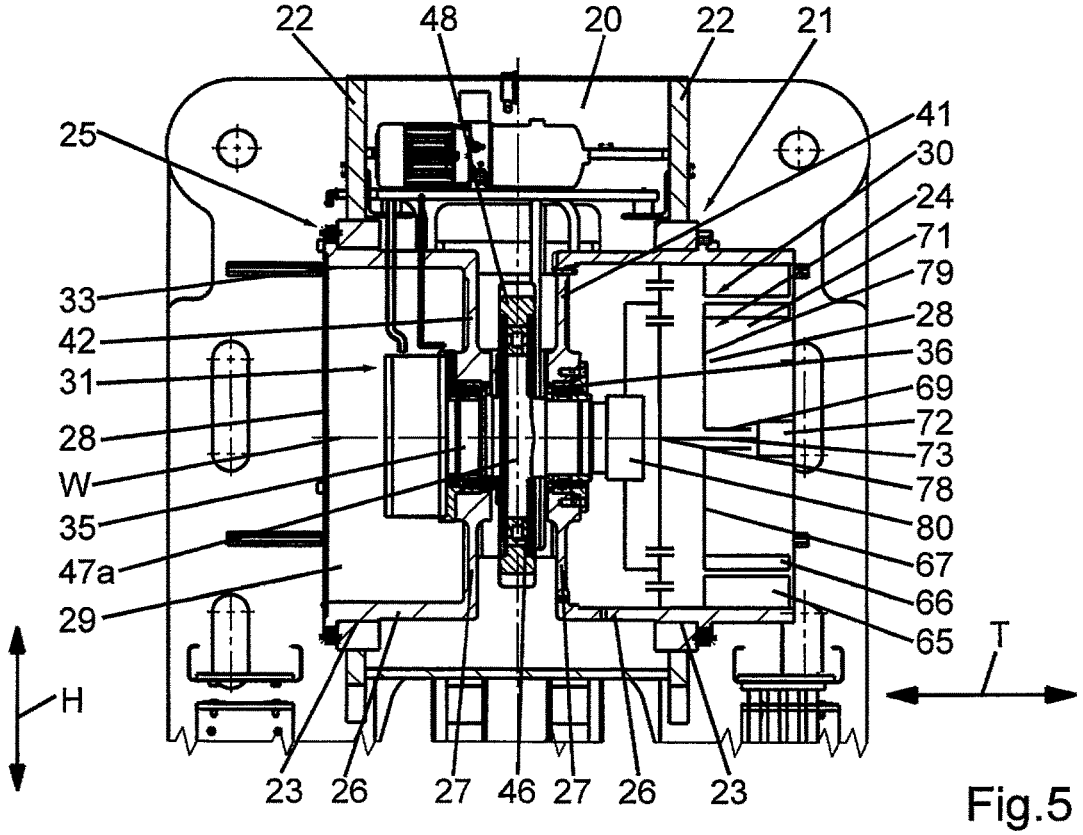
FIG. 5 a partial sectional representation of the press as in FIGS. 1 to 4, in a sectional view along intersection line V-V as in FIG. 2, with a schematically illustrated drive unit.

On the head part 20, the press frame 12 has two press frame plates 22 that are at a distance from each other in depth direction T. The press frame plates 22 extend in a plane that is defined by transverse direction Q and stroke direction H. The two press frame plates 22 comprise, for each press drive device 21, one circular receiving opening 23 (FIG. 5). The receiving openings 23 in the two press frame plates 22 for a joint press drive device 21 are arranged so as to be in alignment in depth direction T and to be coaxial about a shaft axis W of the respective press drive device 21.

The press drive device 21 comprises at least one drive housing. The press drive device 21 according to FIGS. 1 to 7, in accordance with the example, comprises a first drive housing 24 and a second drive housing 25. The first drive housing 24 is arranged in the one press frame plate 22, and the second drive housing 25 is arranged in the respectively other press frame plate 22, respectively coaxially relative to the same shaft axis W. The shaft axis W of each press drive device 21 extends in depth direction T.

Each drive housing 24, 25 has an annular peripheral wall 26 extending in peripheral direction about the shaft axis W in the form of a closed ring and, in accordance with the example, extending coaxially relative to the respective shaft axis W. In accordance with the example, the peripheral wall has a circular form extending around the shaft axis; however, it may also have other forms. In the exemplary embodiment shown in FIGS. 1 to 7, an inside wall 27 is provided that extends essentially radially relative to the respective shaft axis W. The inside wall 27 of a drive housing 24, 25 is located on the axial side on which the drive housing 24, 25 faces the other drive housing 25 or 24. On the side axially opposite the inside wall 27, the respective drive housing 24, 25 has a housing opening 33 (FIG. 5) that is closed by a cover 28. Consequently, an essentially cylindrically contoured housing interior 29 is formed in each drive housing 24, 25. A driving motor 30 and/or a braking device 31 may be arranged in the housing interior 29.

The first drive housing 24, as well as the second drive housing 26, have—on the axial side opposite the inside wall 27—a mounting means for mounting the respective drive housing 24, 25 to the associate press frame plate 22. In accordance with the example, at least one mounting flange 32 is used as mounting means. In the exemplary embodiment illustrated here, the mounting flange 32 is configured as a ring flange and completely encloses the housing opening 33 of the respective drive housing 24, 25. The drive housings 24, 25 can be screwed to their associate press frame plates 22, respectively via holes in the mounting flange 32.

Each drive device 21 comprises a drive shaft 35. In accordance with the example of FIGS. 1 to 7, the drive shaft 35 is configured as an eccentric shaft and—in modification thereof—it could also be a crankshaft (FIGS. 8 to 11).

The drive shaft 35 extends along the shaft axis W and is supported so as to be rotatable about the shaft axis W. Various bearing options are schematically illustrated in FIGS. 8 to 11. A first bearing mechanism 37 is provided at a first bearing location 36 for bearing the drive shaft 35. The first bearing location 36 is formed in a cylindrical bearing recess 38 of the inside wall 27 of the first drive housing 24. The first bearing mechanism 37 is located between the bearing recess 38 and the drive shaft 35. Furthermore, the drive shaft 35 is supported by means of a second bearing location 39 that, in accordance with the example, is formed by a second bearing recess 38 in the inside wall 27 of the second drive housing 25, by means of a second bearing mechanism 40. The second bearing mechanism 40 is arranged between the bearing recess 38 and the drive shaft 35.

Figure 8:
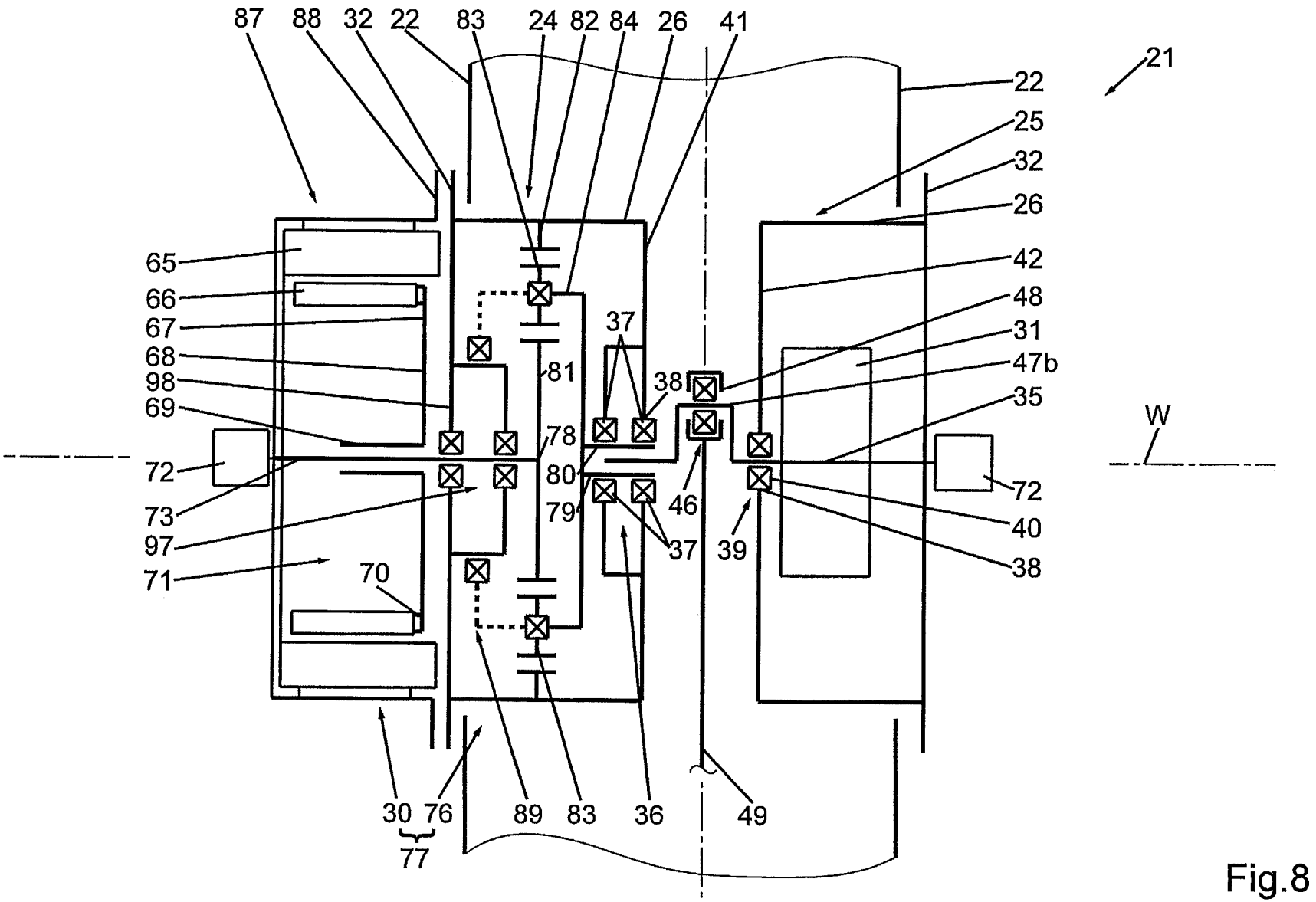
FIGS. 8 to 11 block diagrams of different configurations of a press drive device.
Figure 9:
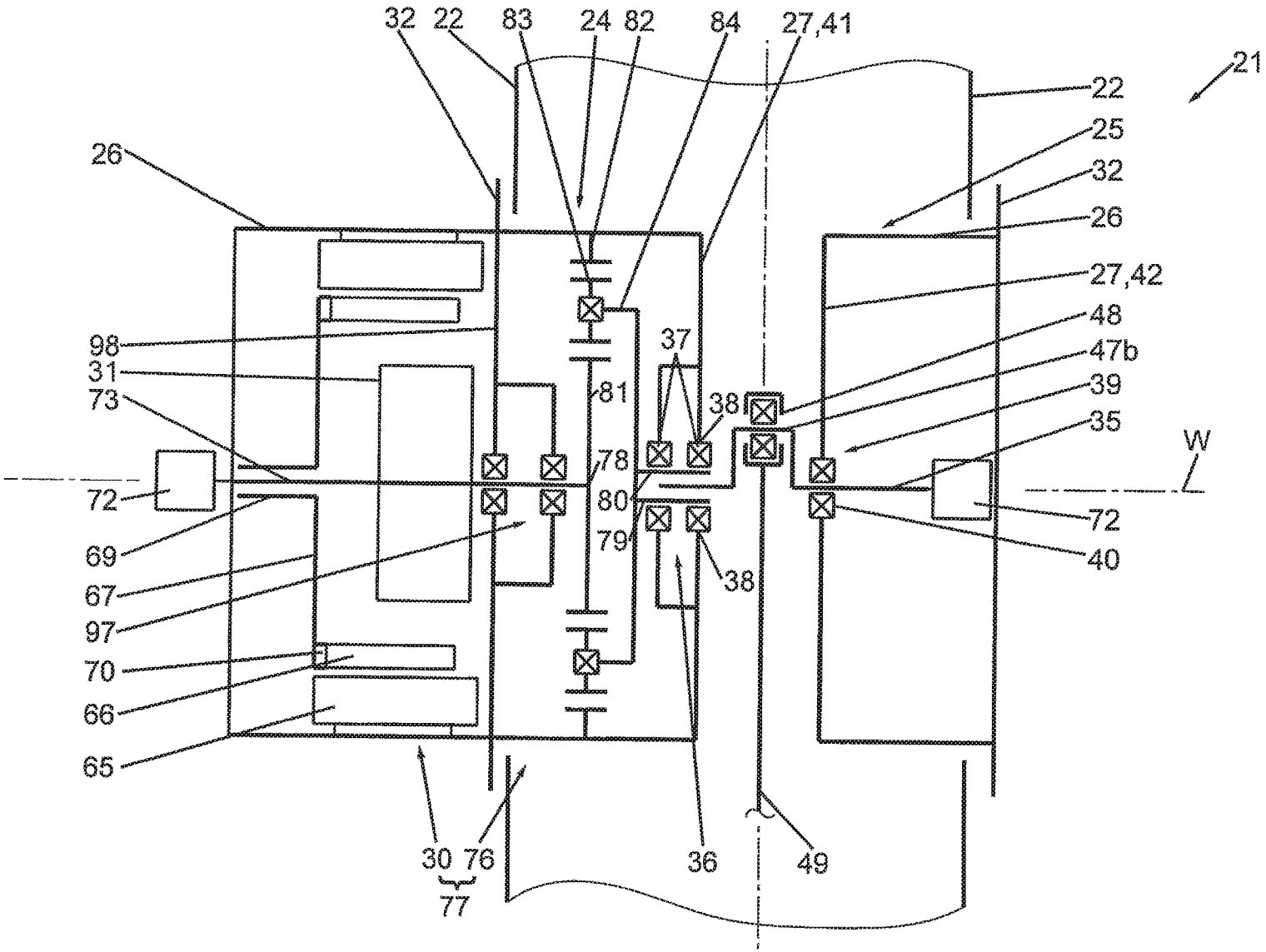

Finally, in accordance with one embodiment, the drive shaft 35 can be supported via the first and the second bearing mechanisms 37, 40 at the first bearing location 36 and the second bearing location 39, respectively (FIGS. 5, 8 and 9). There are no additional bearing locations.

Figure 10:
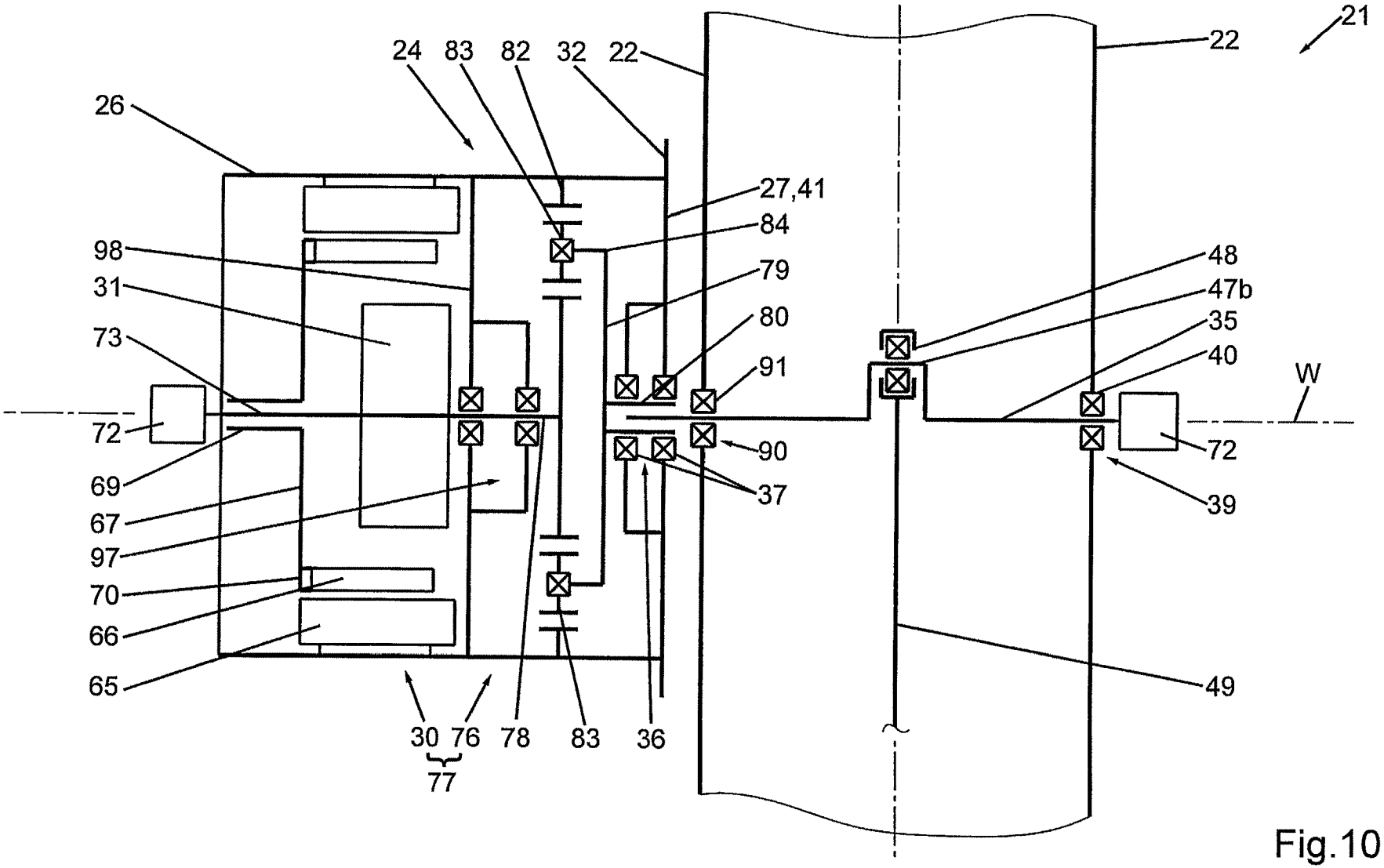

In the exemplary embodiment according to FIGS. 5, 8, 9 and 11, the inside walls 27 having the bearing recesses 38 thus form a first bearing part 41 for the first bearing location 36 and a second bearing part 42 for the second bearing location 39. In modification of this exemplary embodiment, the first bearing part 41 and/or the second bearing part 42 could also be an element of the machine frame 12 (FIG. 10).

At least one of the bearing locations 36, 39 is configured as a fixed bearing in order to prevent an axial shifting of the drive shaft 35. The respectively other bearing location—in accordance with the example, the second bearing location 39 or 36—is configured as a movable bearing in order to prevent tensions and constraining forces in the press drive devices 21.

The drive shaft 35 has a connecting rod bearing 46 between the two bearing locations 36, 39. The connecting rod bearing 46 is arranged so as to be eccentric with respect to shaft axis W. In accordance with the example, the connecting rod bearing 46 is seated on an eccentric part 47*a* or a journal 47*b* of the drive shaft 35 arranged eccentrically with respect to shaft axis W.

In the exemplary embodiment described here, the first and the second bearing mechanisms 37, 40 are roller bearings. In the exemplary embodiment, the connecting rod bearing 46 is, likewise, a roller bearing.

The drive shaft, in accordance with the example the eccentric part 47*a* or the journal 47*b*, is connected to the driving end 48 of a connecting rod 49 via the connecting rod bearing 46. The connecting rod 49 of a respective press drive device 21 extends—as a function of the position of the angle of rotation of the drive shaft 35—in approximately transverse direction Q or slightly obliquely with respect thereto. On the end opposite the driving end 48, the connecting rod 49 has an driven end 50.

The driven end 50 of the connecting rod 49 in the press 10 described here is coupled with an associate toggle lever mechanism 51. It would also be possible to couple the driven end of the connecting rod 49 via an eccentric gear—or also directly—with the press ram 11.

In accordance with the example, each press drive device 21 is associated with a press drive or a toggle lever mechanism 51. In accordance with the example, the two toggle lever mechanisms 51, for example, are illustrated highly schematically in FIG. 7. The specific arrangement of a toggle lever mechanism 51 in the press 10 can be inferred from FIG. 6. Each toggle lever mechanism 51 comprises a first toggle lever 52 and a second toggle lever 53. The two toggle levers 52, 53 are linked to each other via a hinge connection 54—in accordance with the example a hinged joint 55. Furthermore, the second toggle lever 53 is linked to a pressure point 56. The first toggle lever 52 is linked on the end opposite the hinged joint 55 to the press frame 12.

Figure 12:
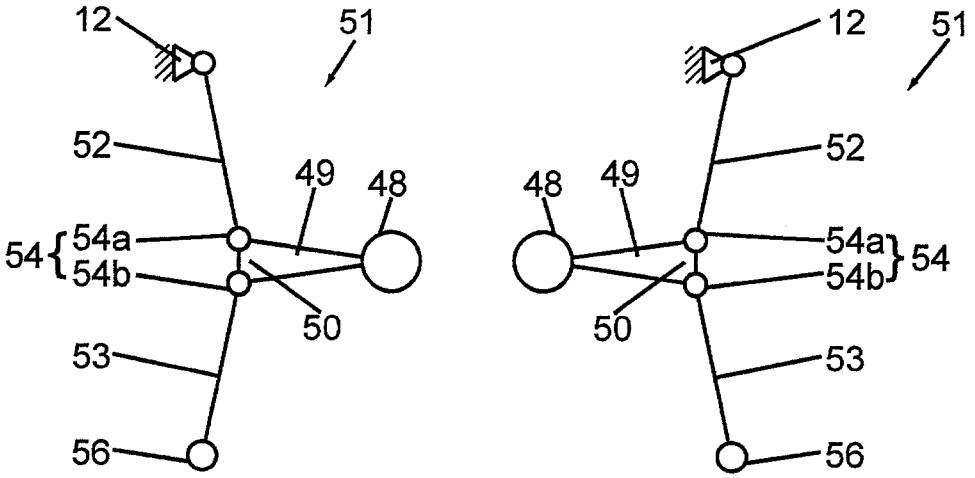
FIG. 12 a schematic representation of the principle of a modified exemplary embodiment of a toggle lever mechanism of the press.

FIG. 12 shows a modified embodiment of the hinge connection 54. The connecting rod 49 has three joint points, i.e., one on the driving end 48 (as in FIG. 7), one joint point 54*a* for the connection to the first toggle lever 52 and one joint point 54*b* for the connection to the second toggle lever 53. Other than that, the toggle lever mechanism 51 corresponds to the toggle lever mechanism 51 of FIG. 8.

Figure 3:
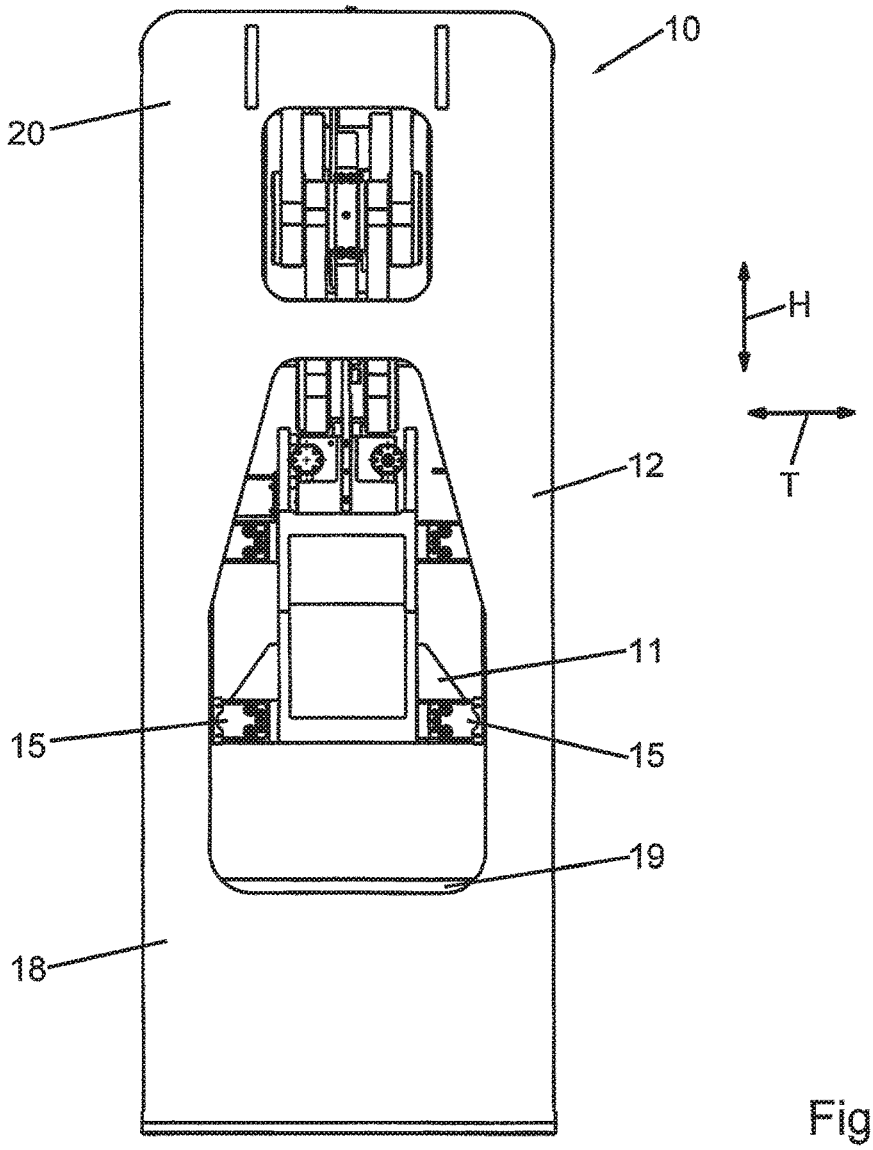
FIG. 3 a side view of the press as in FIGS. 1 and 2.
Figure 6:
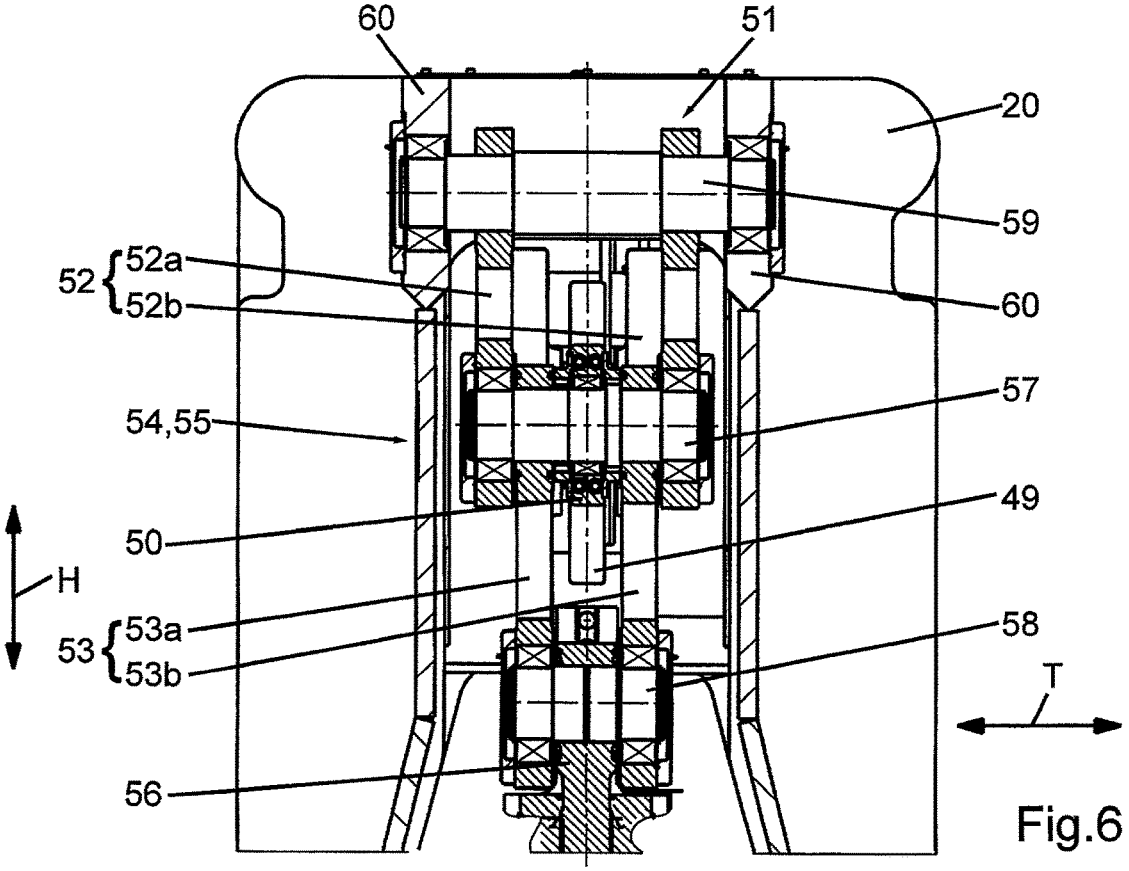
FIG. 6 a partial representation of the press as in FIGS. 1 to 5, in a sectional view along intersection line VI-VI as in FIG. 2.
Figure 13:
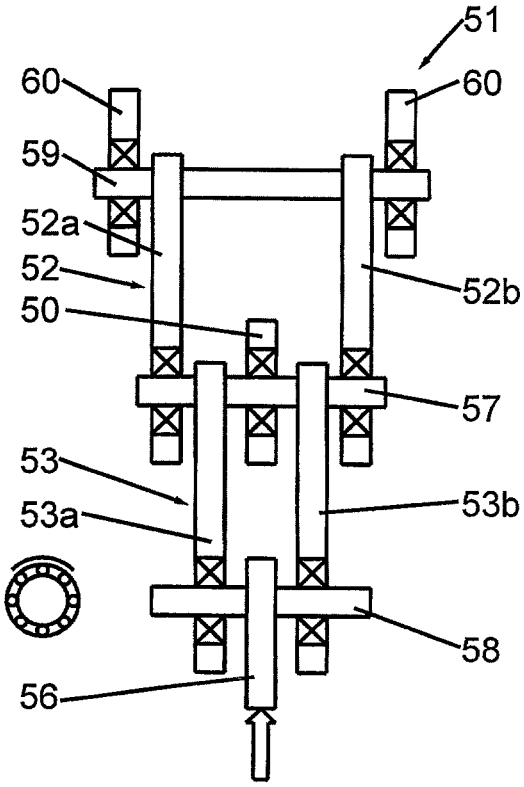
FIG. 13 a schematic representation of the principle of a bearing mechanism for a toggle lever mechanism.

As can be inferred from FIGS. 6 and 13 and in part also from FIG. 3, the hinged joint 55 is formed by a hinged joint pin 57, where the driven end 50 of the connecting rod 49 is supported. In accordance with the example, the second toggle lever 53 is formed by two toggle lever elements 53*a*, 53*b* that enclose the hinged joint pin 57 on one end and are hinged, on the other end, to the respectively associate pressure point 56 of the ram 11 with the aid of a first bearing pin 58. The two toggle lever elements 53*a*, 53*b* are arranged in axial direction of the hinged joint pin 57 on opposite sides of the driven end 50 of the connecting rod 49.

Corresponding to the second toggle lever 53, also the first toggle lever 52 is formed by two toggle lever elements 52*a*, 52*b*. The two toggle lever elements 52*a*, 52*b* are arranged on opposite sides of the hinged joint pin 52, so that the driven end 50 of the connecting rod 49, as well as the ends of the two toggle lever elements 53*a*, 53*b* of the second toggle lever 53 associated with the hinged joint 55, are located in between. Viewed in depth direction T, the distance between the two toggle lever elements 52*a*, 52*b* of the first toggle lever 52 is greater than the distance between the two toggle lever elements 53*a*, 53*b* of the second toggle lever 53. In modification of the illustrated exemplary embodiment, it is also possible to configure the driven end 50 of the connecting rod 49 in a bifurcated manner. The first toggle lever 52 and/or the second toggle lever 53 might also be embodied with only one toggle lever element 52*a* or 52*b* and 53*a* or 53*b*, respectively.

Figure 1:
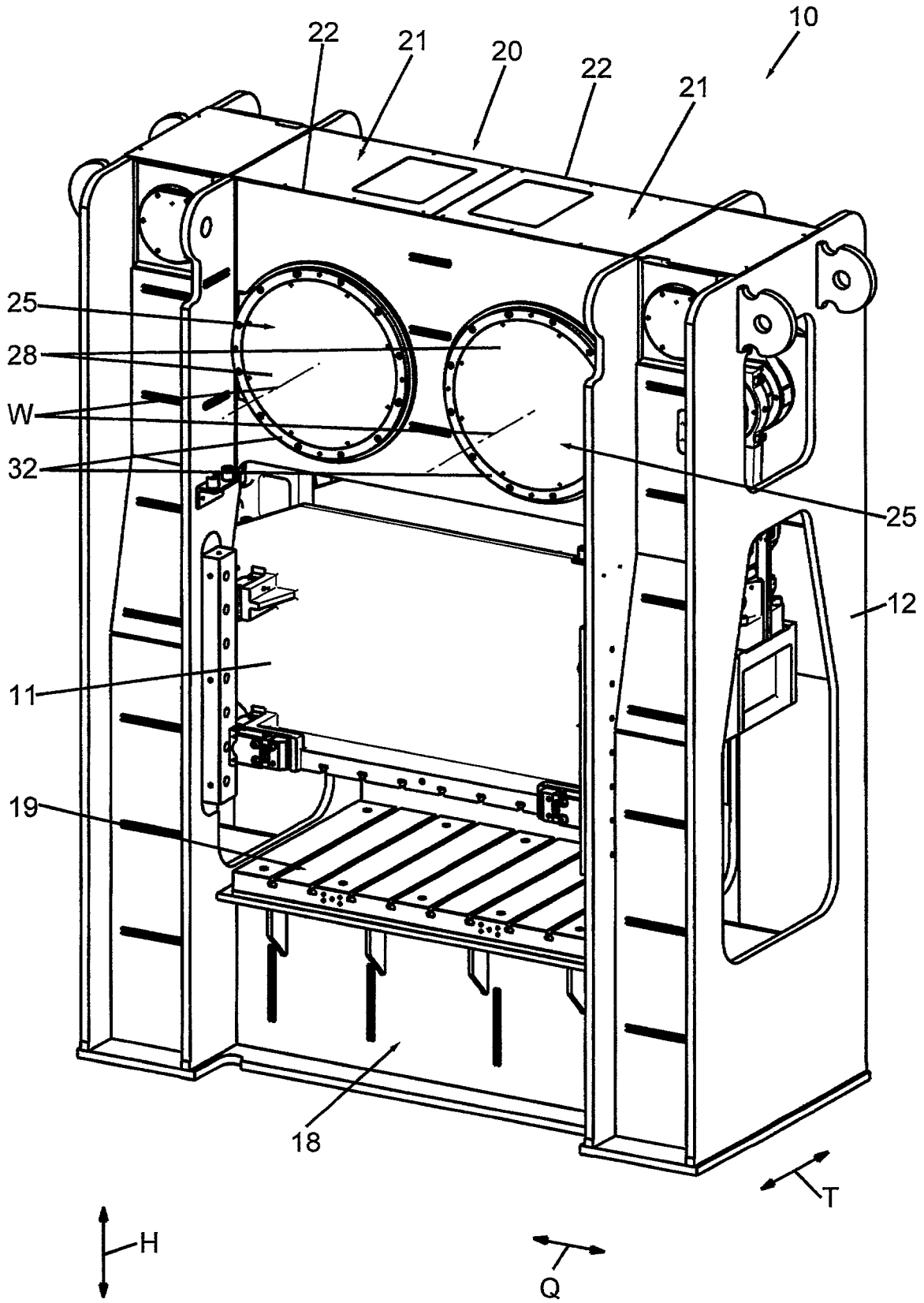
Figure 2:
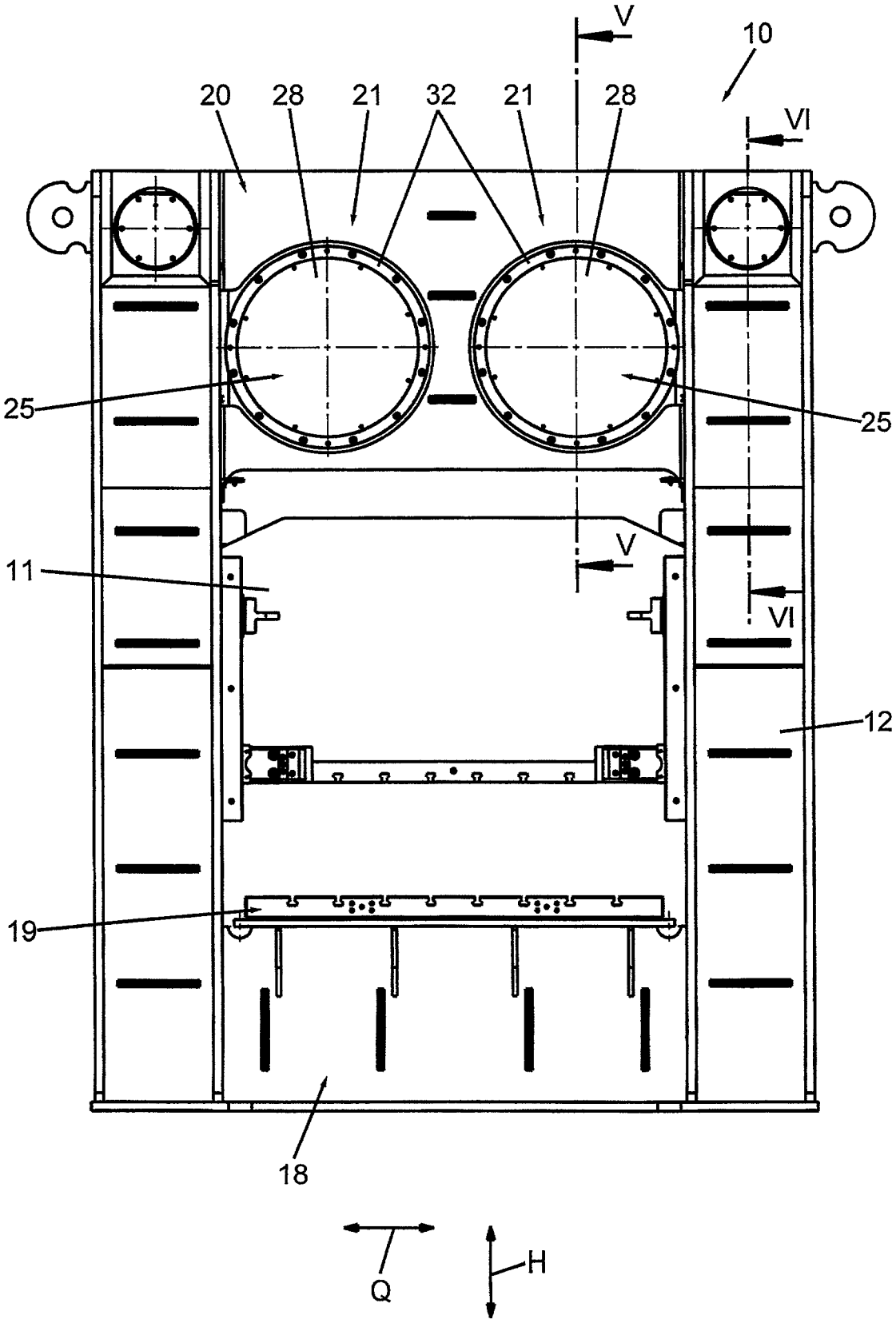
FIG. 2 a front view of the press as in FIG. 1.
Figure 4:
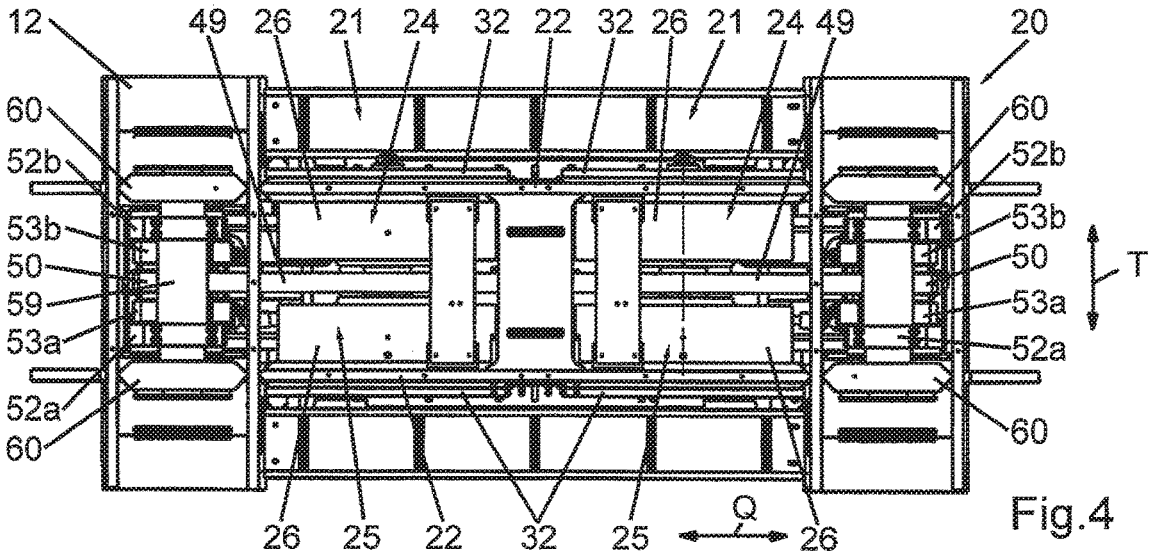
FIG. 4 a plan view of the press as in FIGS. 1 to 3.

On the end opposite the hinged joint 55, the two toggle lever elements 52*a*, 52*b* of the first toggle lever 52 are supported in a hinged manner by the press frame 12 via a second bearing pin 59. According to the example, the second bearing pin 59 is supported on its two axial ends in a bearing recess of a cheek 60 of the press frame 12. In the exemplary embodiment, the two cheeks 60 supporting the second bearing pin 59 are at the same distance as the two press frame plates 22 in depth direction T (FIGS. 1 and 4).

As illustrated by FIGS. 6 and 13, the elements of the toggle lever mechanism 51, said elements being rotatable relative to each other, are supported via a roller bearing. For example, the second bearing pin 59 is supported by the cheeks 60 on the press frame 12 via a roller bearing. The two toggle lever elements 52*a*, 52*b* of the first toggle lever 52 are seated on the second bearing pin 59 in a rotationally fixed manner and are rotatably supported on the second bearing pin 59 via one roller bearing, respectively. The two toggle lever elements 53*a*, 53*b* of the second toggle lever 53 are seated on the hinged joint pin 57 and are rotatably supported—via a roller bearing—on the second bearing pin 59. At the pressure point 56, the second bearing pin 59 is connected to the ram in a rotationally fixed manner.

In FIG. 13 it can be seen that a load is applied to the upper side of the roller bearings by introducing the press force at the pressure point 56 in stroke direction. In an alternative embodiment according to FIG. 14, this load application zone of the bearings is in the lower region. This is accomplished in that the bearings—different from the arrangement of FIG. 13—are arranged between the toggle lever elements 52*a*, 52*b* of the first toggle lever 52 and the second bearing pin 59, between the toggle lever elements 53*a*, 53*b* of the second toggle lever 53 and the hinged joint pin 57, as well as between the pressure point 56 and the first bearing pin 58. The first bearing pin 58 is connected to the toggle lever elements 53*a*, 53*b* of the second toggle lever 53 in a rotationally fixed manner. The hinged joint pin 57 is connected to the toggle lever elements 52*a*, 52*b* of the first toggle lever 52 in a rotationally fixed manner, and the second bearing pin 59 is seated in a rotationally fixed manner in the cheeks 60 of the press frame 12.

Figure 14:
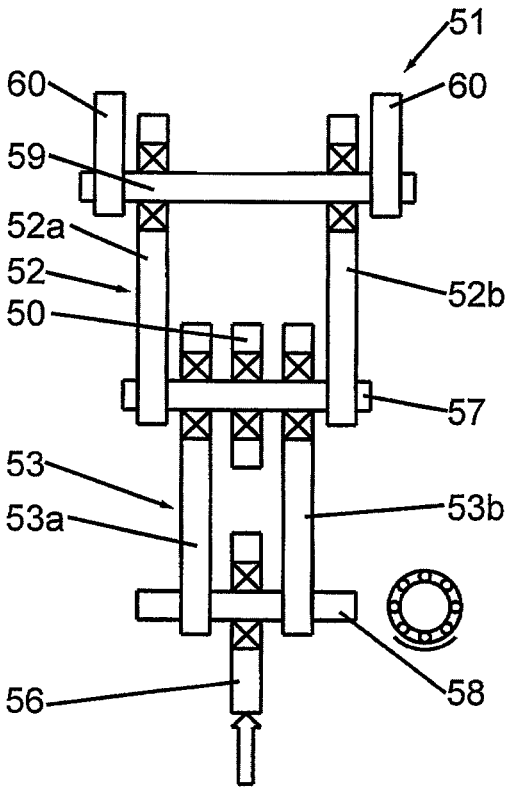
FIG. 14 a schematic representation of the principle of a further bearing mechanism for a toggle lever mechanism.

Compared to the arrangement according to FIG. 13, the arrangement according to FIG. 14 features the advantage that all bearings are located within the outside contour of the press frame or the press body. This facilitates sealing the press body, in the event of oil or grease lubrication, in particular in the case of sliding bearings.

Instead of the roller bearings used for support in accordance with the example, it is possible—in principle—to also use other bearings such as, for example, sliding bearings. Sliding bearings may be advantageous if greater forces act on the specific mounting location of the bearing, which forces can be absorbed only by very expensive roller bearings.

In the exemplary embodiment the ram 11 of the press 10 has two pressure points 56 arranged at a distance from each other in transverse direction Q. The pressure points 56 are arranged along a straight line extending in transverse direction Q. The distance between the two pressure points 56 is greater than the dimension of the press table 19 in transverse direction Q. Therefore, the two pressure points 56 are located not above the press table 19 but, viewed in transverse direction Q, close to the two lateral stands of the press frame that connect the foot part 18 and the head part 20 to each other. As a result of this, a bending stress of the head part 20 does not occur, and the press stiffness is increased.

As explained, each press drive device 21 comprises at least one electric driving motor 30. The at least one driving motor 30 is arranged in the first drive housing 24 or in the second drive housing 25. It is also possible to arrange respectively one driving motor 30 in both drive housings 24, 25. In the exemplary embodiment according to FIGS. 1 to 10, each press drive device 21 comprises one single driving motor 30.

In accordance with the example, the driving motor 30 is arranged in the first drive housing 24. The motor has a stator 65 arranged coaxially with respect to the shaft axis W. In accordance with the example, the stator 65 is mounted to the inside surface of the peripheral wall 26 facing the shaft axis W.

Radially with respect to the shaft axis W, there is arranged—within the stator 65 coaxially around the shaft axis W—a ring-shaped rotor 66. In the exemplary embodiment, the rotor 66 bears permanent magnets. The field coils are arranged in the stator 65. The driving motor 30 is preferably embodied as a servomotor or torque motor. Different from servomotors, the torque motor has a large number of pole pairs and is designed for lower rotational speeds and higher torques. Therefore, in accordance with the example, the diameter of the torque motor is clearly greater, compared to its axial design dimensions.

On its axial end associated with the inside wall 27, the rotor 66 of the driving motor 30 is mounted to a rotor hub 67. In accordance with the example, the rotor hub 67 comprises a disk 68 extending radially or obliquely with respect to the shaft axis W. The radially inner end of this disk 68 is connected to a hollow shaft 69 that is seated on a motor shaft 73. On the radially outside end opposite the hollow shaft 69, the rotor hub has a holding part 70 to which the rotor 66 is mounted.

It is also possible for several spokes—instead of the disk 68—to extend between the hollow shaft 69 and the holding part 70.

The rotor hub 67 is preferably made in one piece, without seams and joints. The rotor hub 67 and the rotor 66 mounted to it have the overall configuration resembling a rim. Radially within the rotor 66 and axially adjacent to the disk 68 or the rotor hub 67, there remains a mounting space or receiving space 71. In this mounting space 71, there is sufficient room in case a braking device 32 is to be installed in addition to a driving motor 30 in a drive housing.

Via the rotor hub 67, the rotor 66 is connected to the drive shaft 35 in a rotationally fixed manner. A rotation of the rotor 66 by a specified angle of rotation about the shaft axis W thus results in the rotation of the motor shaft 73 by the same angle of rotation. The indirect mechanical connection in a rotationally fixed manner between the rotor 66 and the motor shaft 73 is without play, in accordance with the example.

A sensor 72 is arranged on at least one drive housing 24, 25—in accordance with the example, on the first drive housing 24. In accordance with the example, the sensor 72 is seated in extension of the motor shaft 73, whereby the shaft axis W extends through said sensor. The sensor housing is located inside (FIG. 5) or outside the housing interior 29 (FIGS. 8 to 11) and, in accordance with the example, may be arranged on the cover 28 closing the first drive housing 24. The sensor 72 is disposed to detect the rotary position of the driving motor 30. The detection of the rotary position may be with contact or contactless. Each driving motor 30 or each motor shaft 73 is preferably allocated at least one sensor 72.

If several driving motors 30 are connected to one common motor shaft 73, the rotary position of both driving motors 30 can be detected by one shared sensor 72. To do so, the driving motors 30 are mounted in corresponding rotary positions.

Each driving motor 30 is associated with a planetary gear set 76, so that respectively one driving motor 30 and one planetary gear set 76 form a drive unit 77. The planetary gear set is arranged in an intermediate space between the motor shaft 73 and the drive shaft 35, coaxially with respect to shaft axis W. A gear input 78 of the planetary gear set is connected to the motor shaft 73 in a rotationally fixed manner. A gear output 79 is connected to the drive shaft 35 in a rotationally fixed manner. A coupling arrangement 80 is disposed for coupling the gear output 79 with the drive shaft 35. The coupling arrangement 80 allows a relative movement between the gear output 79 and the drive shaft 35, radially with respect to the shaft axis W. In addition, the coupling arrangement 80 can also allow a relative axial movement along the shaft axis W. In the direction of rotation or in peripheral direction about the shaft axis W, the coupling arrangement 80 produces a rotationally fixed coupling, preferably without play. Coupling may take place in a force-locking and/or form-locking manner.

Considering the exemplary embodiments shown by FIGS. 5 and 8 to 11, the first bearing location 36 is located in the region of the gear output 79 or the coupling arrangement 80. The drive shaft 35 is indirectly borne or supported via the coupling arrangement 80 and/or the gear output 79 on the first drive housing 24.

The planetary gear set 76 comprises a sun wheel 81, a hollow wheel 82 arranged coaxially around the sun wheel 81, as well as several planetary wheels 83 that are in engagement with the outside teeth of the sun wheel 81 as well as with the inside teeth of the hollow wheel 82. The hollow wheel 82 is mounted in the housing interior 29 of the first drive housing 24, for example to the peripheral wall 26.

The sun wheel 81 represents the gear input 78. Preferably, it is directly seated on the motor shaft 73 in a rotationally fixed manner and may be an integral part of the motor shaft 73, without any seam and joint. During a rotation of the motor shaft 73, the sun wheel 81 rotates by the same angle of rotation and drives the planetary wheels 83 that roll off the hollow wheel 82.

The planetary wheels 83 are rotatably supported on a planetary wheel carrier 84 of the planetary gear set 76. The planetary wheel carrier 84 is connected to the gear output 79 in a rotationally fixed manner and/or forms the gear output 79, respectively. An output shaft may also act as the gear output 79, said shaft being connected to the planetary wheel carrier 84 in a rotationally fixed manner.

The planetary wheels 83 may be movably supported or—indicated only in a chain line in FIG. 8—be supported via a support unit 89 on the first drive housing 24, radially with respect to the shaft axis W.

The drive unit 77 may be arranged in a common drive housing—in accordance with the example, the first drive housing 24—and/or the second drive housing 25 (FIGS. 5 and 9 to 11). Alternatively, it is also possible to arrange the planetary gear set 76 and the driving motor 30 of a drive unit 77 in two separate drive housings. As an example, the schematic in FIG. 8 illustrates that the planetary gear set 76 in the first drive housing 24 and the associate driving motor 30 of the drive unit 77 is arranged in a third drive housing 87, wherein the third drive housing 87 can be connected via a connecting flange 88 arranged coaxially with respect to the shaft axis W to the first mounting flange 32. It is understood that other connecting possibilities between to axially adjacently arranged drive housings 24, 87 can also be applied.

The sensor 72 for the detection of the rotary position of the motor shaft 73 can also be used to determine the ram position. Considering the rotary position of the motor shaft 73, it is possible, by means of the known gear ratio, to determine the rotary position of the drive shaft 35 and thus the position of the ram. It is particularly advantageous if the gear ratio of the planetary gear set 76 is a whole number from the gear input 78 to the gear output 79, or a decimal number with a finite number of decimal places, for example 3 to 5 decimal places, in order to allow an exact calculation.

Alternatively thereto, it is also possible to provide another sensor 72 that detects the rotary position of the drive shaft 35. This additional sensor 72 for the detection of the rotary position of the drive shaft 35 is optional.

Figure 11:
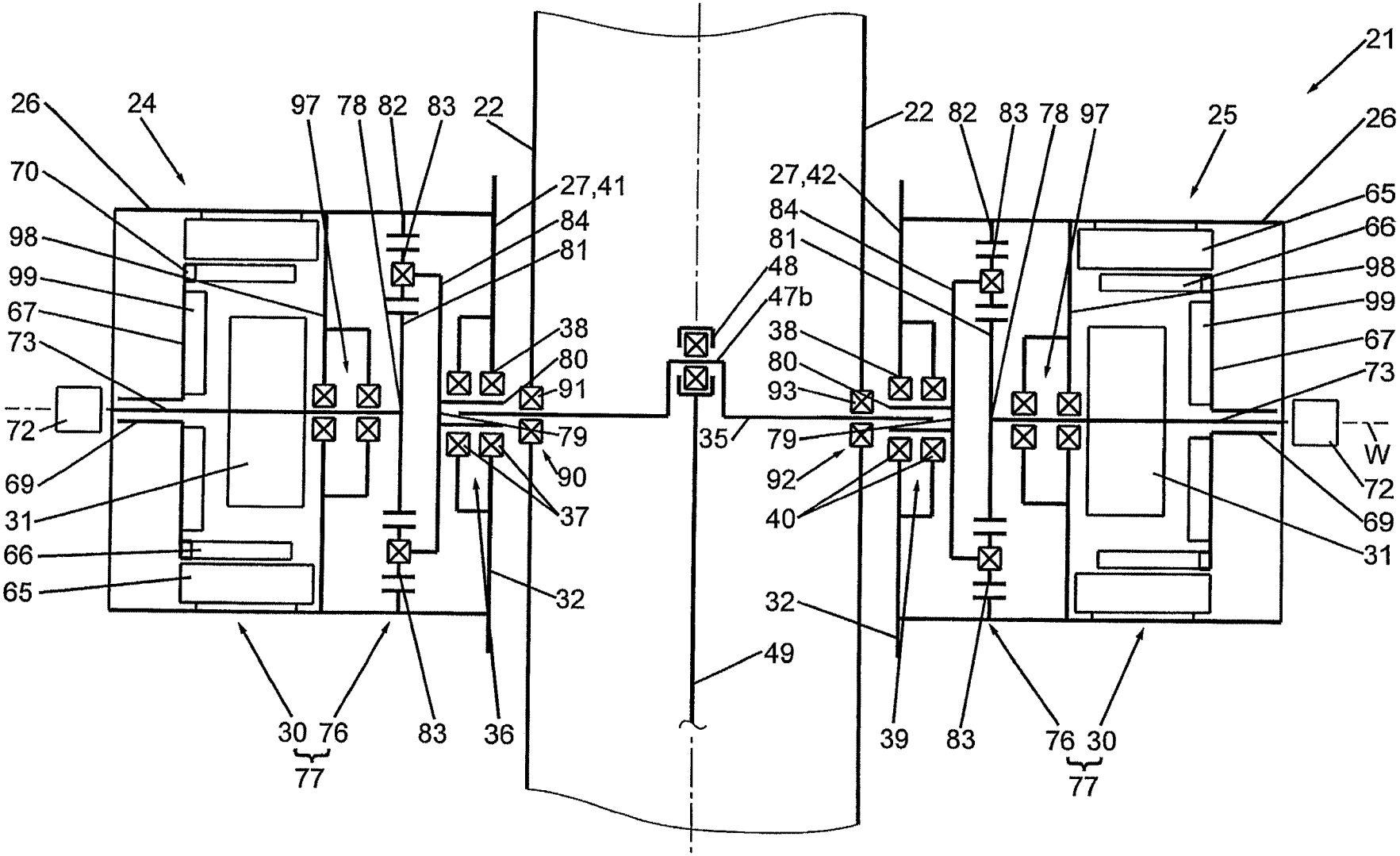

In the exemplary embodiments according to FIGS. 1 to 8 and 11, the braking device 31 is arranged in the second drive housing 25. Alternatively or additionally, it is also possible for there to be a braking device 31 in the first drive housing 24 (FIGS. 9, 10 and 11). If a drive unit 77 is present in the drive housing 24, 25, there remains room for the arrangement of the braking device in the mounting space 71. A brake part is connected to the second drive housing—for example, the inside wall 27, while the other brake part is connected to the drive shaft 35 in a rotationally fixed manner. On the inside of the inside wall 27, there are provided—in accordance with the example—appropriate mounting means for the braking device 31 or its part that is rigidly mounted to the housing. In the event of an emergency situation, for example in the event of an electrical power failure of the press drive device 21, the braking device 31 is triggered and stops the rotary motion of the drive shaft 35 and thus the oscillating movement of the ram 11. Each drive device 21 comprises at least one braking device 31.

The press 10 does not have a hydraulic overload protection. The overload protection is performed by an electrical or electronic activation of the at least one electric driving motor 30 of each press drive device 21.

The electric driving motors 30 of different press drive devices 21 are not permanently mechanically coupled to each other. The coordinated rotation of the electrical driving motors 30 of different press drive devices 21 about the respectively associate shaft axis W is accomplished by the press control. Therefore, there is a coordination of the rotary motion of the driving motors 30 of different press drive devices 21 due to control or regulatory measures.

As a result of the fact that the press drive devices 21 are not permanently mechanically coupled, another position of the respective pressure point 56 in stroke direction H can be specified via each press drive device 21. In order to avoid damaging the guide of the ram 11, the guide allows the ram 11 at least one additional degree of freedom of movement in the movement in stroke direction H, i.e., as defined by depth direction T and transverse direction Q. In accordance with the example, the inclined position is a tilting position about an axis parallel to depth direction T.

If, in one modified exemplary embodiment, pressure points 56 are additionally arranged in depth direction T at a distance from each other, a tilting movement may additionally be allowed about an axis that is oriented parallel to transverse direction Q. In the exemplary embodiment illustrated here, the ram 11 is supported at twelve locations above respectively one roll 15 opposite an abutment surface 13 on the side of the press frame (FIG. 7). Four abutment surfaces 13 have a normal vector in depth direction T, and four abutment surfaces have a normal vector in transverse direction Q. In stroke direction, the rolls 15 are arranged at two spaced apart height levels on the ram 11. At the one height level—in accordance with the example the lower height level—one roll 15 is in abutment with each of the eight abutment surfaces 13. At the other height level—in accordance with the example the upper height level—respectively one roll 15 is in abutment with only the four abutment surfaces 13 having a normal vector pointing in depth direction T. As a result of this, a tilting of the ram 11 about an axis parallel to depth direction T becomes possible. In the same manner, a tilting about an axis parallel to transverse direction Q could be realized alternatively if, at the other height level, e.g. at the upper height level, the rolls 15 abut against the four abutment surfaces 13 that have a normal vector pointing in transverse direction Q with one roll respectively. If the rolls 15 are arranged at only one height level, a tilting of the ram 11 about the axes in two spatial directions T, Q is possible.

The press 10 comprises two not illustrated force sensors in order to detect the press force applied by the ram 11. The force sensors may be arranged at any point in the drive train between the driving motor and the ram 11. For example, a force sensor for the detection of the press force may be present on each toggle lever mechanism 51. The sensor signal of the force sensor is output to the control of the press 10 and evaluated. In order to avoid an overload, it is detected—dependent on the actual rotary position and thus dependent on the actual position of the ram 11, as well as dependent on the sensor signal of the force sensor—whether or not an overload and hence damage of the press 10, the tool or the workpiece is threatened. In this event, the at least one driving motor 30 can be energized or switched to generator mode in such a manner that a braking force counter the actual direction of rotation is generated and the ram movement is stopped. Also, such an overload function can be implemented by regulating or control measures, without the use of hydraulic overload devices.

If a press drive device 21 comprises several driving motors 30, this can increase the drive torque and/or the rated power path. Preferably, the existing driving motors 30 of a shared press drive device 21 are activated by one press control, for example via separate frequency converters. If, in a forming task, the torque of all driving motors 30 is not needed or if, during the ram movement, at least in one section of the movement profile the torque of all driving motors 30 is not needed, it is possible to operate one or more of the driving motors, for example, passively without power or in generator mode. It is also possible to activate the driving motors 30 in such a manner that, overall, the losses of all driving motors 30 are minimized. In doing so, the existing driving motors 30 are activated in such a manner that the required torque is provided by the driving motors 30 in such a manner that the highest-possible total degree of efficiency is the result. In order to have a greater variability, it is also possible to use driving motors 30 with different torque/power characteristics and/or different characteristic maps of efficiency.

In generator mode, it is possible, for example, to feed energy back into the energy storage in an electrical intermediate circuit. This energy can be used during the subsequent working stroke. As a result of this, the mains load can be reduced.

Depending on the forming task, the press ram 11 can be moved with any movement profile in stroke direction H. For example, the press ram 11 can be stopped in the bottom dead center. For an oscillating movement of the press ram 11, the at least one driving motor can reverse its direction of rotation in the upper dead center and in the bottom dead center of the ram movement and can thus be driven so as to oscillate within one rotary angle range. It is also possible to select the rotary angle range symmetrically or asymmetrically around the bottom dead center, so that—after each reversal of the direction of rotation of the at least one driving motor 30—the bottom dead center of the ram movement is passed. Furthermore, the at least one driving motor 30 can be driven—without reversal of the direction of rotation—so as to rotate about the shaft axis W. Consequently, a slide movement may occur according to the following principles:

path-bound as in a conventional gyrating mass press, or
force-bound as in a hydraulic press, or
energy-bound as in a forging press comprising a spindle, or the hammer principle.

FIGS. 8 to 11 show different configurations of a press drive device 21. As has already been explained, the configuration according to FIG. 8 shows a first drive housing 84 with a planetary gear set 76, and, connected thereto, a third drive housing 87 with the driving motor 30 of the drive unit 77, and a second drive housing 25 with a braking device 31. The second drive housing 25 is arranged opposite the connecting rod bearing 46 on the axially opposite side.

The exemplary embodiment according to FIG. 9 essentially corresponds to the configuration of FIG. 8. The difference is that the second drive housing 25 here is disposed only for providing the second bearing location 39 with the second bearing mechanism 40. The breaking device 31 is arranged between the planetary gear set 76 and the driving motor 30 of the drive unit 77. In order to make this possible, the rotor hub 67 is connected to the end of the rotor 66 that faces axially away from the planetary gear set. As a result of this, a sufficiently large mounting space 21 is provided radially inside of the rotor 66 around the motor shaft 73, in which mounting space the braking device 31 is arranged.

Another difference from the exemplary embodiment according to FIG. 9, compared with the embodiment according to FIG. 8, consists in that the drive unit 77 is completely arranged in the first drive housing 24. Inasmuch as there is a sufficiently large mounting space available in the second drive housing 25, a sensor 72 detecting the rotary position of the drive shaft 35 can be arranged inside the second drive housing 25.

In the embodiment shown schematically in FIG. 10, only the first drive housing 24 is provided. In this embodiment, the first drive housing 24 is completely arranged outside the intermediate space between the two press frame walls 22 of the press frame 12. Here, the mounting flange 32 of the first drive housing 24 is arranged on the axial side associated with the press frame 12. The second bearing location 39 or the second bearing mechanism 40 is arranged between the drive shaft 35 and the press frame 12 or the press frame wall 22. In addition, a further, third bearing location 90 with a third bearing mechanism 91 may be provided on the press frame wall 22 adjacent to the first drive housing 24.

In the embodiment shown by FIG. 11, the arrangement of the drive unit 77 and the braking device 31 in the first drive housing 24 corresponds to the configuration according to FIG. 10. Here, the arrangement of the drive unit 77 and the braking device 31 in the second drive housing 25 is analogous to that of the first drive housing 24. The first bearing location 36 is provided on the first drive housing 24, and the second bearing location 39 is provided on the second drive housing 25. Analogous to the third bearing location 90, there is provided directly adjacent to the second bearing location 39, a fourth bearing location 92 with a fourth bearing mechanism 93.

The further bearing mechanisms 91, 93 suggested by FIGS. 10 and 11 may be expedient if large forces from the connecting rod 49 act on the drive shaft 35, said forces being better able to be absorbed against the press frame 12 than against a drive housing 24, 25. Other than that, it would also be possible in the embodiments according to FIGS. 10 and 11 to optionally omit the third bearing location 90 and/or the fourth bearing location 92.

As can further be inferred from FIGS. 8 to 11, a motor shaft bearing mechanism 97 is provided for bearing the motor shaft 73. The motor shaft bearing mechanism 97 is provided in a support wall 98 of the first drive housing 24 and, in the exemplary embodiment according to FIG. 11, also in the second drive housing 25. The support wall 98 is arranged adjacent to the gear input 78 and may form an axial cutoff wall (FIG. 8) or be embodied as the intermediate wall on the interior of the drive housing 24 or 25 (FIGS. 9 to 11).

In the exemplary embodiment described here, the motor shaft 73 is supported only via the motor shaft bearing mechanism 97 on the support wall 98. Also, the rotor hub 67 and/or the rotor are rotatably supported via the motor shaft bearing mechanism 97, in which case, in accordance with the example, additional bearing mechanisms for the rotor 66 and/or the rotor hub 67 are not provided at additional bearing locations. Starting from the rotor 66 or the rotor hub 67, the support of the motor shaft 73 takes place—together with the rotor hub 67 and the rotor 66—axially on only one side of the drive motor 30 or the rotor hub 67.

In all embodiments of the press drive device 21 it would be possible—in principle—to use an external rotor motor instead of the internal rotor motor as in the example, which, however, is less favorable in view of the compact arrangement in the drive housing.

In all embodiments of the press drive device 21, the rotor and/or the rotor hub and/or other parts that are connected to the drive shaft 35 in a rotationally fixed manner may act as a gyrating mass by increasing their mass and/or by including at least one momentum element (FIG. 11). The free mounting space available in the housing interior 29 can be utilized in order to provide such an additional gyrating mass.

The invention relates to a press drive device 21 for a press 10, comprising a connecting rod 49 that has an driving end 48 and an driven end 50. The driven end 50 is preferably coupled to a ram 11 via a press gear unit. A drive shaft 35 is mounted so as to be rotatable about a shaft axis W and includes a connecting rod bearing 46 that is eccentric in relation to the shaft axis W. A drive unit 77 comprising a driving motor 30 and a planetary gear set 76 is used for driving the drive shaft 35. For this purpose, a gear output 79 is connected in a rotationally fixed manner to the drive shaft 35, and a gear input 78 is connected in a rotationally fixed manner to a motor shaft 73. The driving motor 30 comprises a rotor 66 that is connected in a rotationally fixed manner to the motor shaft 73 via a rotor hub 67. The rotor 66 is hollow cylindrical and is concentric to the motor shaft 73. This creates mounting space located between the motor shaft 73 and the rotor 66 and designed to arrange a braking device 31 therein.

LIST OF REFERENCE SIGNS

10 Press
11 Ram
12 Press frame
13 Contact surface
15 Roll
18 Foot part
19 Press table
20 Head part

21 Press drive device
22 Press frame plate
23 Receiving opening
24 First drive housing
25 Second drive housing
26 Peripheral wall
27 Inside wall
28 Cover
29 Housing interior
30 Driving motor
31 Braking device
32 Mounting flange
33 Housing opening
35 Drive shaft
36 First bearing location
37 First bearing mechanism
38 Bearing recess
39 Second bearing location
40 Second bearing mechanism
41 First bearing part
42 Second bearing part
46 Connecting rod bearing
47*a* Eccentric part
47*b* Journal
48 Driving end
49 Connecting rod
50 Driven end
51 Toggle lever mechanism
52 First toggle lever
52*a* Toggle lever element of the first toggle lever
52*b* Toggle lever element of the first toggle lever
53 Second toggle lever
53*a* Toggle lever element of the second toggle lever
53*b* Toggle lever element of the second toggle lever
54 Hinge connection
54*a* Joint point
54*b* Joint point
55 Hinged joint
56 Pressure point
57 Hinged joint pin
58 First bearing pin
59 Second bearing pin
60 Cheek
65 Stator
66 Rotor
67 Rotor hub
68 Disk
69 Hollow shaft
70 Holding part
71 Mounting space, receiving space
72 Sensor
73 Motor shaft
76 Planetary gear set
77 Drive unit
78 Gear input
79 Gear output
80 Coupling arrangement
83 Planetary wheel
84 Planetary wheel carrier
87 Third drive housing
88 Connecting flange
89 Support unit
90 Third bearing location
91 Third bearing mechanism
92 Fourth bearing location
93 Fourth bearing mechanism
97 Motor shaft bearing mechanism
98 Support wall
99 Momentum element
H Stroke direction
Q Transverse direction
T Depth direction
W Shaft axis

The invention claimed is:

1. A press drive device for a press, the press drive device comprising:

a connecting rod that has a driving end and a driven end, a drive shaft that can be rotated about a shaft axis and has a connecting rod bearing arranged eccentrically opposite the shaft axis, said connecting rod bearing supporting the driving end of the connecting rod, at least one drive housing that has a peripheral wall extending in peripheral direction around the shaft axis and/or extending coaxially with respect to the shaft axis, wherein at least one of the at least one drive housing is associated with a driving motor that comprises a stator and a hollow cylindrical rotor, a rotor hub connected to a motor shaft in a rotationally fixed manner and to which is mounted the rotor, at least one planetary gear set that comprises a gear input connected to the motor shaft in a rotationally fixed manner and a gear output connected to the drive shaft in a rotationally fixed manner, and that is arranged in one of the at least one drive housing, a motor shaft bearing mechanism of at least one of the at least one drive housing, wherein the motor shaft, the rotor, and the rotor hub are only supported by the motor shaft bearing mechanism, wherein the motor shaft bearing mechanism is disposed between the motor shaft and the at least one drive housing, wherein the rotor and the rotor hub are supported on the motor shaft and are only indirectly supported at the housing via the motor shaft and the motor shaft bearing mechanism, wherein a mounting space exists radially between the motor shaft and the rotor and axially adjacent to the rotor hub, said mounting space being configured to allow mounting a braking device in the at least one drive housing.

2. The press drive device according to claim 1, wherein the gear input is a sun wheel of the at least one planetary gear set.

3. The press drive device according to claim 2, wherein the sun wheel (81) is directly connected to the motor shaft in a rotationally fixed manner.

4. The press drive device according to claim 1, wherein the gear output is a planetary wheel carrier of the at least one planetary gear set.

5. The press drive device according to claim 1, wherein the gear output is coupled via a coupling arrangement to the drive shaft in a rotationally fixed manner, wherein the coupling arrangement allows a relative movement radially with respect to the shaft axis between the drive shaft and the gear output.

6. The press drive device according to claim 1, wherein, at a first bearing location, there is provided a first bearing mechanism that supports the drive shaft on a first bearing part, and that, at a second bearing location, there is provided a second bearing mechanism that supports the drive shaft on a second bearing part, wherein the first bearing location and the second bearing location are arranged on axially different sides of the connecting rod bearing.

7. The press drive device according to claim 6, wherein the first bearing part with the first bearing location is a component of the first drive housing and/or that the second bearing part with the second bearing location is a component of a second drive housing.

8. The press drive device according to claim 6, wherein one of the first bearing mechanism or the second bearing mechanism forms a fixed bearing, and an other of the first bearing mechanism or the second bearing mechanism forms a movable bearing.

9. The press drive device according to claim 1, wherein one of the at least one planetary gear set and the driving motor form a drive unit that is arranged in a common one of the at least one drive housing.

10. The press drive device according to claim 1, wherein the mounting space for the braking device is located axially between the motor shaft bearing mechanism and the rotor hub.

11. The press drive device according to claim 1, wherein the rotor hub comprises a disk extending radially with respect to the shaft axis or comprises spokes extending radially with respect to the shaft axis.

12. The press drive device according to claim 1, wherein the rotor hub comprises a hollow shaft that encloses the motor shaft and is connected to the motor shaft in a rotationally fixed manner.

13. The press drive device according to claim 1, further comprising the braking device arranged in at least one of the at least one drive housing.

14. The press drive device according to claim 1, wherein, in at least one of the at least one drive housing, there are arranged the driving motor, as well as the braking device, the braking device being arranged axially adjacent to the rotor hub and arranged at least partially in a space between the rotor and the shaft axis.

15. A press comprising:

a press frame on which a ram is supported so as to be movably guided in a stroke direction, at least one toggle lever mechanism that comprises a first toggle lever and a second toggle lever which are connected to each other by a hinge connection, wherein the first toggle lever is hinged to the press frame and the second toggle lever is hinged to the ram at a pressure point, and at least one press drive device comprising:

a connecting rod that has a driving end and a driven end, a drive shaft that can be rotated about a shaft axis and has a connecting rod bearing arranged eccentrically opposite the shaft axis, said connecting rod bearing supporting the driving end of the connecting rod, at least one drive housing that has a peripheral wall extending in peripheral direction around the shaft axis and/or extending coaxially with respect to the shaft axis, wherein at least one of the at least one drive housing is associated with a driving motor that comprises a stator and a hollow cylindrical rotor, a rotor hub connected to a motor shaft in a rotationally fixed manner and to which is mounted the rotor, at least one planetary gear set that comprises a gear input connected to the motor shaft in a rotationally fixed manner and a gear output connected to the drive shaft in a rotationally fixed manner, and that is arranged in one of the at least one drive housing, a motor shaft bearing mechanism of at least one of the at least one drive housing, wherein the motor shaft, the rotor, and the rotor hub are only supported by the motor shaft bearing mechanism, wherein the motor shaft bearing mechanism is disposed between the motor shaft and the at least one drive housing, wherein the rotor and the rotor hub are supported on the motor shaft and are only indirectly supported at the housing via the motor shaft and the motor shaft bearing mechanism, wherein a mounting space exists radially between the motor shaft and the rotor and axially adjacent to the rotor hub, said mounting space configured to allow mounting a braking device in the at least one drive housing, wherein the driven end of the connecting rod is connected to the hinge connection.

16. The press according to claim 15, further comprising two press drive devices of the at least one press drive device, each of said drives being movably coupled with the ram via one toggle lever mechanism, respectively.

17. The press according to claim 15, further comprising a first and/or a second drive housing of the at least one press drive device defining a housing interior, in which the driving motor and/or the braking device are arranged, wherein the housing interior is arranged within an outside contour of the press frame.

* * * * *